US006146181A

United States Patent [19]

Plaza

[11] Patent Number: 6,146,181

[45] Date of Patent: Nov. 14, 2000

[54] INTERLOCKING ELECTRICAL CONNECTOR ASSEMBLY HAVING A GUIDING MEMBER AND REMOVAL RECESS

[76] Inventor: Aaron M. Plaza, c/o Beau Interconnect, 4 Aviation Dr., Gilford, N.H. 03246-6600

[21] Appl. No.: 09/192,378

[22] Filed: Nov. 16, 1998

[51] Int. Cl.[7] ..... H01R 13/627

[52] U.S. Cl. ..... 439/357

[58] Field of Search ..... 439/345, 350, 439/357, 358

[56] References Cited

U.S. PATENT DOCUMENTS

| | | | |
|---|---|---|---|
| 3,603,910 | 9/1971 | Schumacher | 339/45 |
| 4,405,192 | 9/1983 | Eaby et al. | 339/91 R |
| 4,410,222 | 10/1983 | Enomoto et al. | 339/17 F |
| 4,711,511 | 12/1987 | Noorily | 439/347 |
| 4,737,120 | 4/1988 | Grabbe et al. | 439/326 |
| 4,973,268 | 11/1990 | Smith et al. | 439/595 |
| 5,002,504 | 3/1991 | Carlson | 439/599 |
| 5,015,200 | 5/1991 | Abernethy | 439/357 |
| 5,049,511 | 9/1991 | Yu | 439/325 |
| 5,186,645 | 2/1993 | Bixler | 439/358 |
| 5,211,571 | 5/1993 | Arai et al. | 439/325 |
| 5,314,356 | 5/1994 | Isohata et al. | 439/681 |
| 5,451,170 | 9/1995 | Suffi | 439/404 |
| 5,525,071 | 6/1996 | Obara et al. | 439/326 |
| 5,593,309 | 1/1997 | Post et al. | 439/157 |
| 5,702,266 | 12/1997 | Jones | 439/357 |
| 5,738,549 | 4/1998 | Laquerbe | 439/724 |
| 5,759,058 | 6/1998 | Childs et al. | 439/352 |

FOREIGN PATENT DOCUMENTS

| | | | |
|---|---|---|---|
| 0 631 348A | 12/1994 | European Pat. Off. | H01R 13/627 |
| 19603626 | 8/1997 | Germany | H01R 13/52 |
| WO 97 47058 | 12/1997 | WIPO | H01R 13/648 |

OTHER PUBLICATIONS

Advertisement "Conxrite" of Visual Communications Company, Inc., San Diego, CA, 1 page.

*Primary Examiner*—Neil Abrams
*Assistant Examiner*—Eugene G. Byrd
*Attorney, Agent, or Firm*—Fitzpatrick, Cella, Harper & Scinto

[57] ABSTRACT

A locking electrical connector assembly for locking together a plug and a header. The assembly includes a plug having a plug body, a first electrical contact located the plug body capable of receiving a wire, an opening in the plug body capable of receiving a second electrical contact from a header where the second electrical contact makes electrical connection to the first electrical contact, a first interlocking portion provided on a first side of the plug body for interlocking with a corresponding first interlocking portion of the header, and a second interlocking portion located on a second side opposite from the first side for interlocking with a corresponding second interlocking portion of the header. The header includes a first surface having the corresponding first interlocking portion for interlocking with the first interlocking portion of the plug, a second surface having the corresponding second interlocking portion for interlocking with the second interlocking portion of the plug, and a third surface integrated with the first and the second surfaces having an opening for housing the second electrical contact.

33 Claims, 12 Drawing Sheets

FIG. 10A
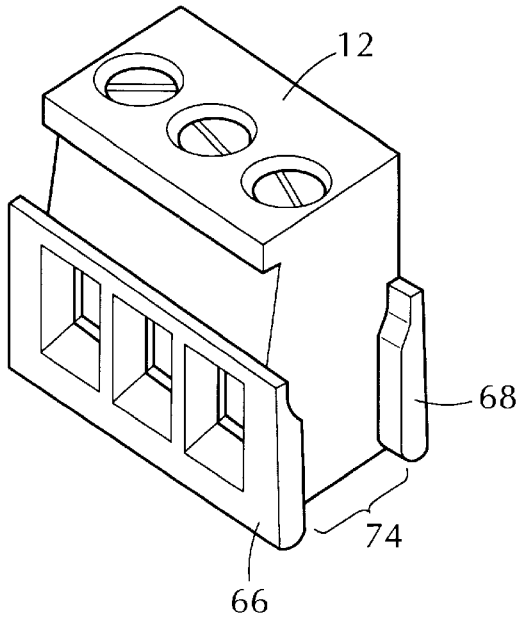
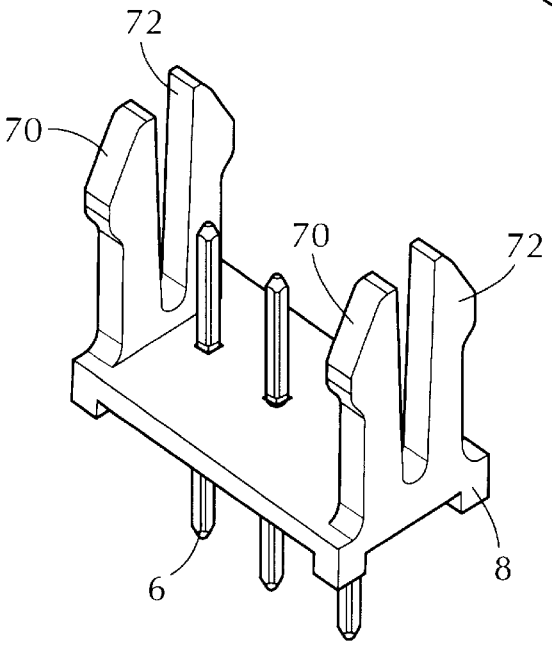
FIG. 10B
FIG. 10C
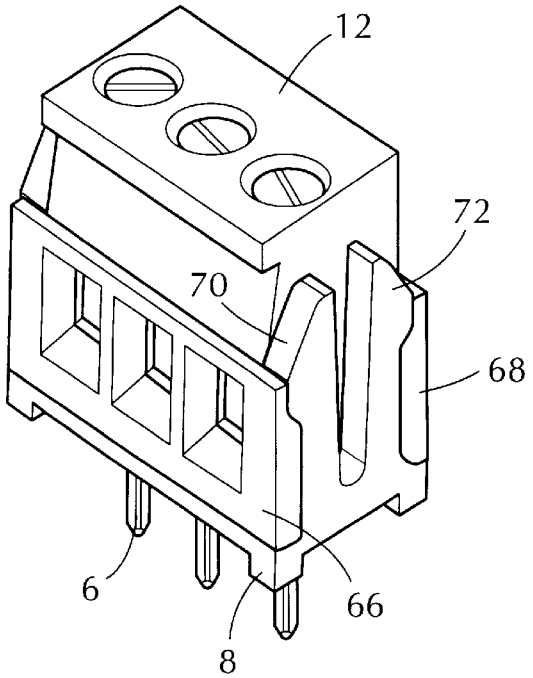

INTERLOCKING ELECTRICAL CONNECTOR ASSEMBLY HAVING A GUIDING MEMBER AND REMOVAL RECESS

FIELD OF THE INVENTION

This invention relates generally to the field of electrical connectors having wire to wire connections or wire to printed circuit board connection. More specifically, this invention relates to a header and plug connector assembly having interlocking portions for securing the plug to the header.

BACKGROUND OF THE INVENTION

One of the problems facing plug and header-type electrical connectors is providing an adequate, secure connection of the plug to the header. Specifically, there exists a problem of temporary or even permanent electrical disconnection between the plug and the header due to various disturbances (e.g., vibration; motion of equipment; environment; etc.). In particular, most prior art plug and header electrical connector assemblies depend solely on the frictional contact between the electrical connection pins of the header and the plug to provide the securing force for the assembly. However, this minimum securing force provides little, if any, help in combating the effects of the various disturbances mentioned above.

Some prior art plug and header assemblies have tried to address this problem. First, as shown in FIG. 1A, one prior art plug 12 and header 8 assembly utilized a pair of side latching mechanisms 3. These latching mechanisms consisted of two protruding members, or prongs, positioned on either side of the header, which were received by two corresponding receiving areas on the sides of the plug. This assembly, however, provided little help in resolving the problem of disconnection due to vibration or other disturbances. Specifically, when considerable force was placed on the front or back side of the plug, the wire connections moved causing the plug to rock back and forth. This rocking motion caused the receiving areas for the prongs to move relative to the prongs, which in turn increased the possibility that the prongs would slip off the receiving areas causing electrical disconnection.

The prior art also tried utilizing a single latching mechanism 5 to resolve the problem as shown in FIG. 1B. Although this prevented some front to back movement of the plug 12 against the header 8, it did not totally alleviate the problem. By only addressing one side of the connection, the plug is still allowed to move from front to back, relative to the header, and especially at the side opposite the latching mechanism. This movement led eventually to the plug working its way off the pins of the header and eventual disconnection.

Another way to insure a complete and secure connection between the plug and header is to permanently affix the plug to the header after initial connection by using screw-type fasteners or adhesives. However, industry standards require that the plug be removable from the header with a tool. For that reason, adhesives are eliminated from consideration, since they permanently join the plug to the header. Although screw-type fasteners provide a secure connection and also conform the assembly to the industry tool-removal requirement, they add a labor factor and time-consuming constraint. In addition, screw type fasteners increase the material cost for the assembly.

Thus, all of the prior art assemblies that tried to address disconnection problems fail in their attempt to provide a cost-effective, secure, quick and easily removable plug and header assembly for preventing temporary or permanent electrical disconnection.

In addition to the problem of securing the plug to the header, there also exists the problem of misconnecting the electrical members of the header to the appropriate openings in the plug 12, resulting from the misalignment of the plug to the pins of the header when initially connecting the plug to the header. This can occur because the pins of the header and the electrical receiving portions in the plug are equally spaced apart at specified standard distances. A particular pin receiving portion destined for a corresponding pin from the header can easily, and inadvertently, be misplaced onto the wrong pin. The resulting misconnection can lead to a variety of problems such as non-functioning or damaged equipment, damage to the plug and header assembly, and hazardous electrical conditions that can cause shock or fire.

As shown in FIG. 1C, the prior art discloses one solution to this misconnecting problem. FIG. 1C shows the use of a separate "U" shaped pin 7 that is inserted through predrilled holes in the header 8 and also received in a corresponding receiving area on the plug 12 when the plug is properly mated to the header. However, an installer can still mis-align the plug and header initially, only to find out that the assembly is not properly aligned when the installer attempts to install the alignment pin, which will not be received into the plug since it is not properly aligned. In addition to this problem, extra manufacturing costs are encountered since a separate pin must be supplied and installed.

SUMMARY OF THE INVENTION

Accordingly, it is an object of the present invention to provide an improved electrical connector assembly.

It is another object of the present invention to provide a plug and header which overcomes the above-mentioned problems.

It is still another object of the present invention to provide a removable plug connector for a securely locking connection to a header.

It is still another object of the present invention to provide an electrical connector assembly having a member for correctly guiding the connection of a plug to a header.

It is yet a further object of the present invention to provide a quick and easily removable locking electrical connector assembly.

In one aspect of the invention, a locking electrical plug connector is provided that includes a plug body, a first electrical contact located on the plug body capable of receiving a wire, an opening in the plug body capable of receiving a second electrical contact from a header where the second electrical contact makes electrical connection to the first electrical contact portion, a first interlocking portion provided on a first side of the plug body for interlocking with a corresponding first interlocking portion of the header, and a second interlocking portion located on a second side opposite from the first side for interlocking with a corresponding second interlocking portion of the header.

In another aspect of the invention, a locking header is provided that includes a first surface having a first interlocking portion for interlocking with a first interlocking portion of a plug, a second surface having a second interlocking portion for interlocking with a second interlocking portion of the plug, and a third surface integrated with the first and the second surfaces having an opening housing an electrical contact for connection to the plug and to an external device.

In yet another aspect of the invention, a locking electrical connector assembly is provided that includes a plug having a plug body, a first electrical contact portion located on the plug body capable of receiving a wire, an opening in the plug body capable of receiving a second electrical contact from a header where the second electrical contact makes electrical connection to the first electrical contact portion, a first interlocking portion provided on a first side of the plug body for interlocking with a corresponding first interlocking portion of the header, and a second interlocking portion located on a second side opposite from the first side for interlocking with a corresponding second interlocking portion of the header. The header includes a first surface having the corresponding first interlocking portion for interlocking with the first interlocking portion of the plug, a second surface having the corresponding second interlocking portion for interlocking with the second interlocking portion of the plug, and a third surface integrated with the first and the second surfaces having an opening for housing an electrical contact for connection to the plug and an external device.

These and other objects and aspects, and many of the attendant advantages of this invention, will be readily appreciated and better understood by reference to the following detailed description when considered in connection with the accompanying drawings summarized below.

BRIEF DESCRIPTION OF THE DRAWINGS

FIG. 10A is a perspective view of a plug for an electrical connector assembly according to a third embodiment of the present invention.

FIG. 10B is a perspective view of a header for the electrical connector assembly according to the third embodiment of the present invention.

FIG. 10C is a perspective view of the plug and header electrical connector assembly according to the third embodiment of the present invention.

DESCRIPTION OF THE PREFERRED EMBODIMENTS

Figure 1A:
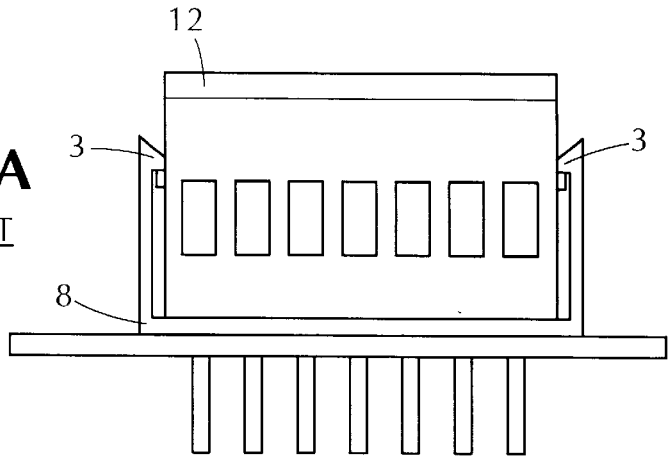
FIG. 1A PRIOR ART
FIG. 1A is a front view of an electrical connector assembly according to the prior art.
Figure 1B:
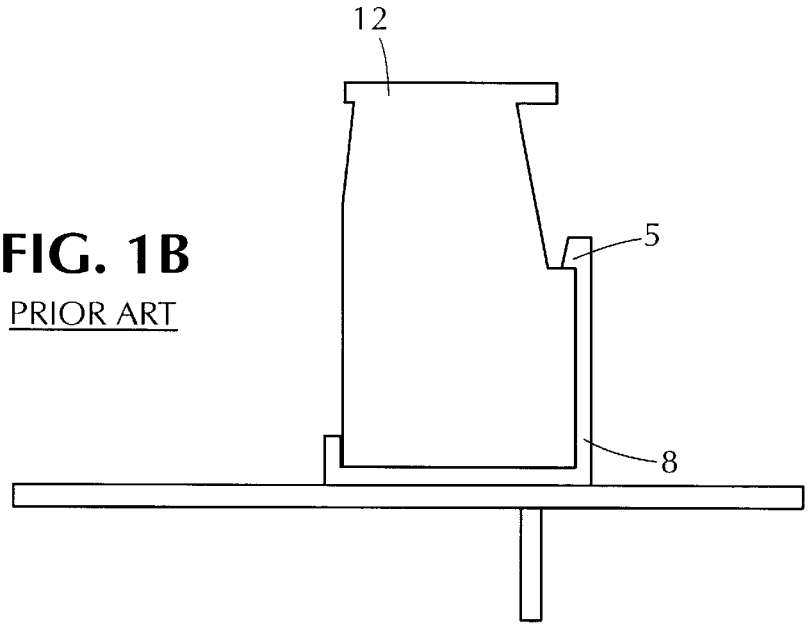
FIG. 1B PRIOR ART
FIG. 1B is a side view of another electrical connector assembly according to the prior art.
Figure 1C:
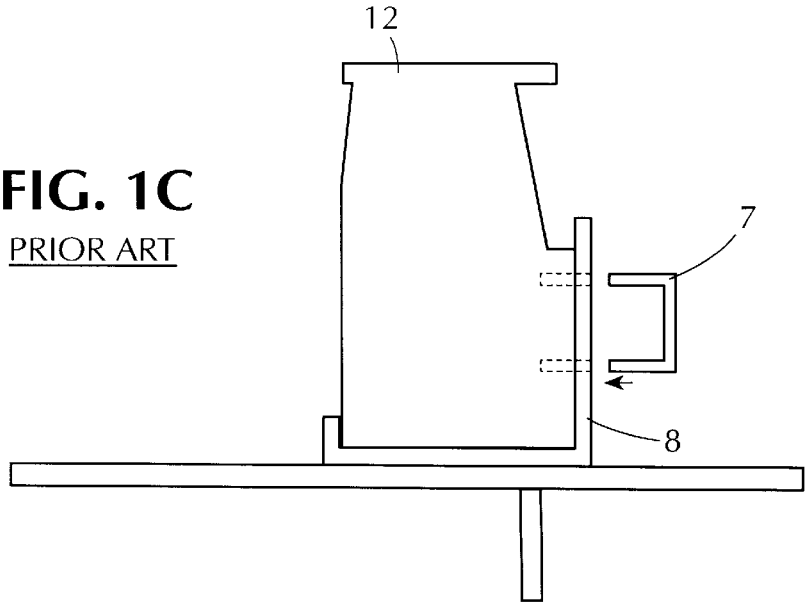
FIG. 1C PRIOR ART
FIG. 1C is a side view of yet another electrical connector assembly according to the prior art.
Figure 1D:
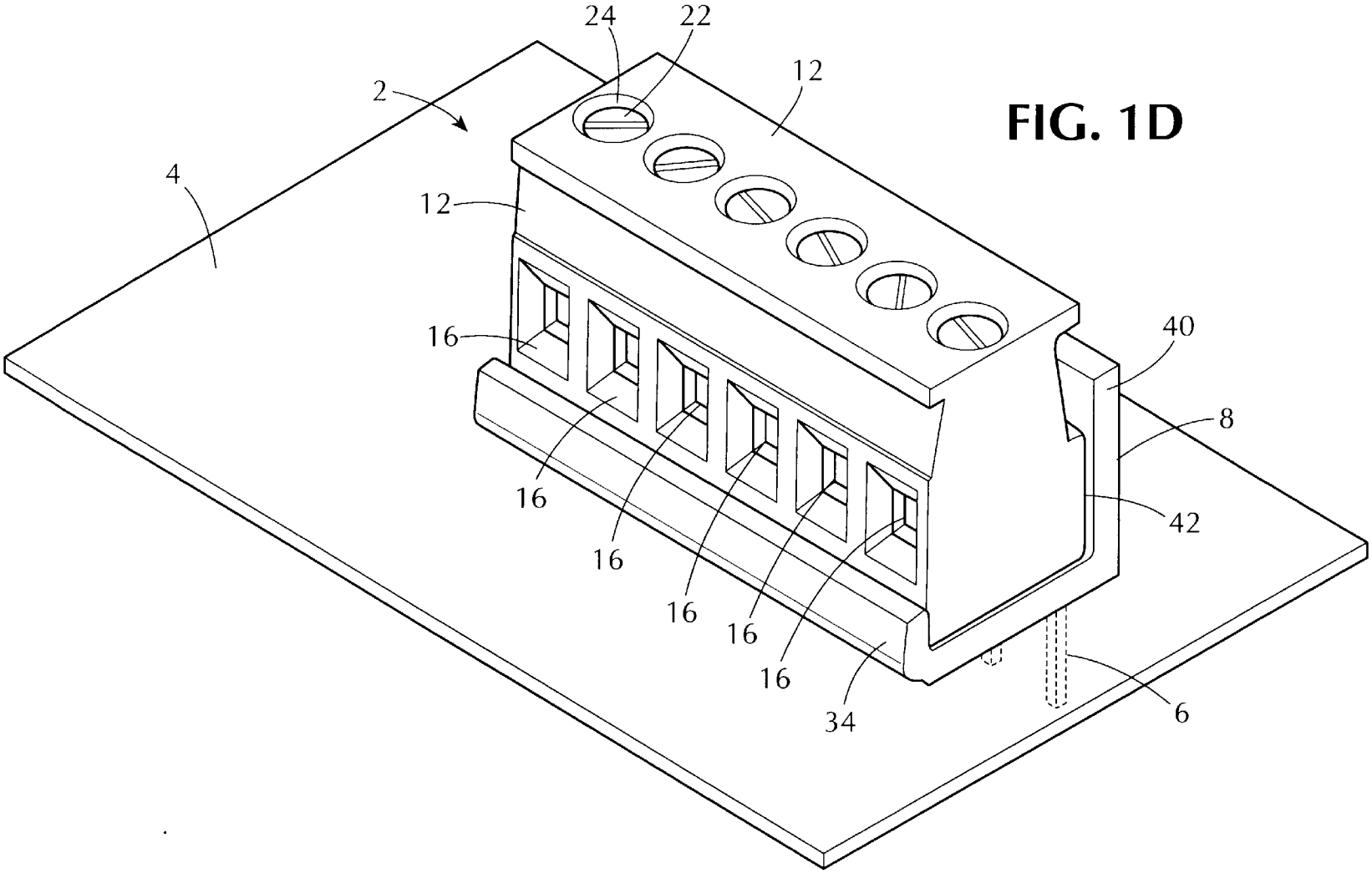
FIG. 1D is a perspective view of the electrical connector assembly according to a first embodiment of the present invention.

Referring to FIG. 1D, there is illustrated an electrical connector assembly 2 positioned on a printed circuit board 4, which receives electrical contact portions 6 from the header 8 of the assembly 2. Electrical contact portions 6 are also received in the printed circuit board 4 (an external device) for electrical connection thereto. Although the present invention is disclosed being used in conjunction with a printed circuit board, the assembly 2 could be used in other applications not utilizing such a device. FIG. 1D also shows the electrical contact portions 6 of the header to be electrically conductive male contacts or pins.

The assembly 2 includes a header 8, having the pins 6 in openings 10 (shown in FIG. 2) which are affixed to the header by frictional fit, adhesive, welding, press-fitting or the like. Using any of these methods allows the pins 6 to be held tightly onto the header 8, which allows the connected assembly to avoid inadvertent electrical disconnection to the printed circuit board 4 (or other external device) due to vibration or other disturbances.

Connected to the header 8 is a connector or plug 12. The plug contains electrical contact portions 14 located on the underneath side of the plug in openings 10*a*, which are used to receive the pins 6. The electrical contact portions 14 include a female type of contact to receive pins 6, however, the contacts could also be either male or female, depending upon the electrical contacts of the header.

Figure 2:
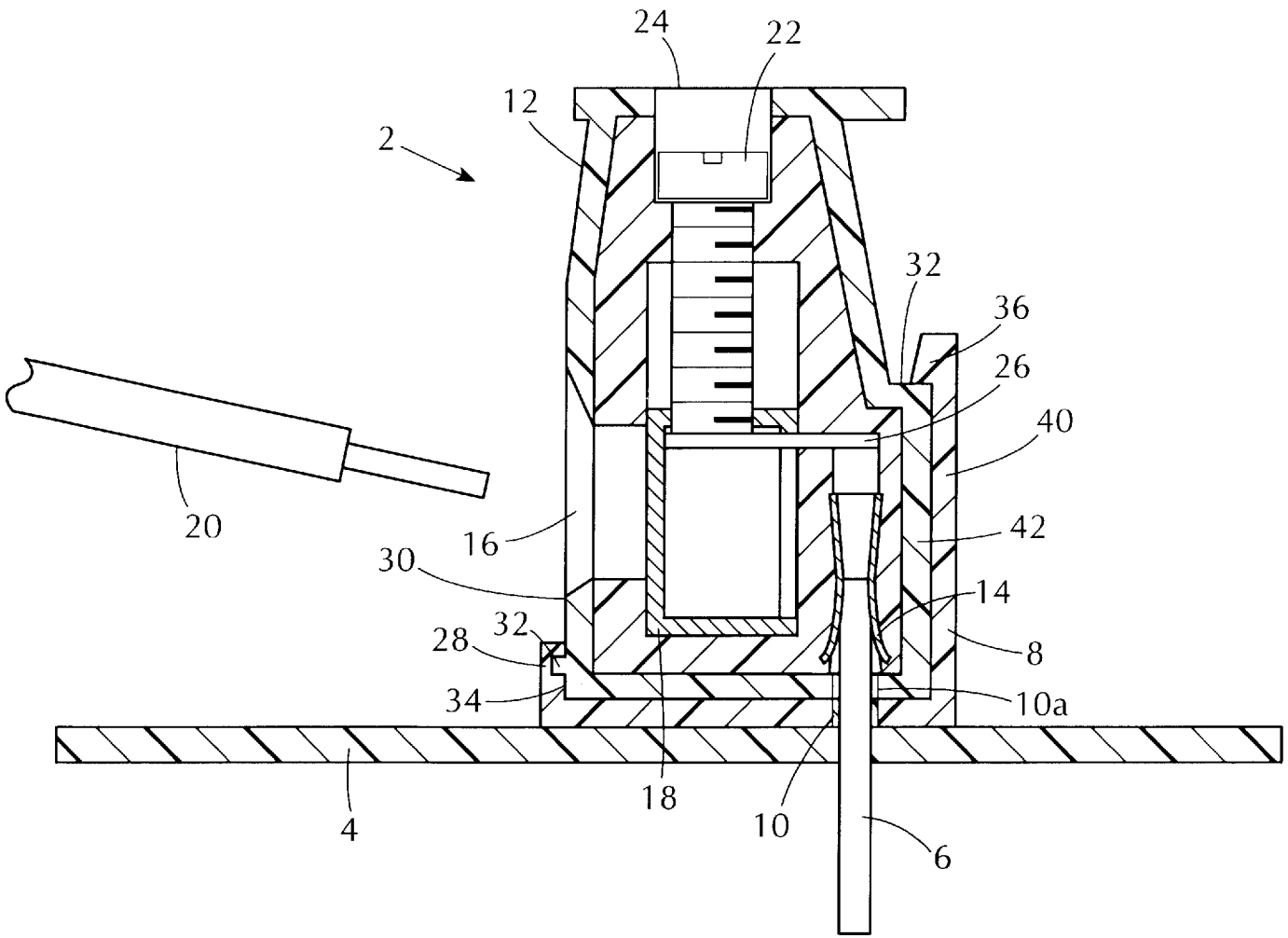
FIG. 2 is a side, sectional view of the electrical connector assembly according to the first embodiment of the present invention.

As illustrated in FIG. 2, the plug 12 also includes electrical wire receiving portions 16, which are receptacles housing electrically conductive moving cage clamp, or elevator clamp, connectors 18 for receiving wires. The electrical wire receiving portions 16 may be positioned on any side of the plug body, with the electrically conductive moving cage clamps positioned accordingly, so that electrical connection can be made to the electrical contact portion 14 positioned on the plug body.

The moving cage clamps 18 are electrically connected to the electrical contact portion 14, thus providing throughput from the electrical pins 6 of the header from the printed circuit board 4 to the wires 20 received by the receptacles 16.

The moving cage clamps 18 are operated by turning screws 22, located in top openings 24 of plug 12. The screws are threaded into the cage 18, causing the cage 18 to rise when turned in a particular direction, and provide a securing means of securing the wire 20 between the bottom of the cage 18 and the electrical contact 26 (which is electrically connected to the electrical contact portion 14) received by the cage 18 to electrically connect the contact 26 with the cage 18. The receptacles can also be of the screw-type wire clamp (not shown), which uses a flat pressure plate (washer) mounted under the head of a screw, where the external wire is clamped between the underneath side of the head of the screw and the pressure plate.

The latching mechanism according to the first embodiment for the present invention is shown in FIG. 2. When the plug 12 and header 8 are connected, the plug 12 is installed in the direction of travel of the pins 6 which are received by the electrical contact portion 14 through openings 10 and 10*a* of the header 8 and plug 12, respectively. First interlocking portions 32 located on a first side 30 of the plug 12 are interlocked with corresponding interlocking portions 28 on a first surface 34 of the header 8. In FIG. 2, the first interlocking portions of the plug include cams 32, or other similarly shaped protruding members, which are received by corresponding receiving portions 28 in the first surface 34 of the header. The cams 32 and the receiving portions 28 may be reversed, such that the cams 32 may be located on the header 8 and the receiving portions may be located on the plug 12.

Similarly, second interlocking portion 36 of the header 8 interlock with second interlocking portion 38 of the plug 12. In FIG. 2, the second interlocking portion includes cam or protruding member 36 located on the header 8, being received on edge 38 of the plug 12. The second interlocking portions illustrated in FIG. 2 may also be reversed, such that the receiving surface may be disposed on the header 8 and the cam may be disposed on the plug 12.

Both sets of interlocking portions, first and second, may constitute a single protruding member and a single receiving portion, or a plurality of protruding members and a plurality of receiving portions. Selection of the number of protruding members and receiving portions would depend on the design criteria set out for the particular application. However, for most applications, a single protruding member and receiving portion provided on the first and second sides of the assembly would adequately secure the plug 12 to the header 8. The interlocking portions are provided on sides of the plug and header in planes that are positioned substantially parallel to linear alignment plane of the pins 6.

As shown in the figures, the first and second interlocking portions may also be spatially arranged at a vertical and horizontal distance apart form one another (i.e., the interlocking portions are positioned on different vertical and horizontal planes).

When the plug 12 and the header 8 are connected, the plug 12 is nestled between the first 34 and second 40 walls of the header 8. In order for the plug 12 to lock with the header 8, part of the header must flex in order to accommodate the additional space required by the protruding member. Specifically, when the plug 12 is brought together with the header 8, being installed in the direction of the travel of the pins 6, the first interlocking portions are brought together initially, and then the side of the plug 12 having the second interlocking portion is pushed down to snap into position. As the second side of the plug 12 is pushed down, the protruding member used in the second interlocking portion (being located either on the header or the plug) forces the rear wall 40 of the header 8 out. When the protruding member is finally received by the receiving portion, the plug 12 snaps into place with an audible "snap".

Figure 3:
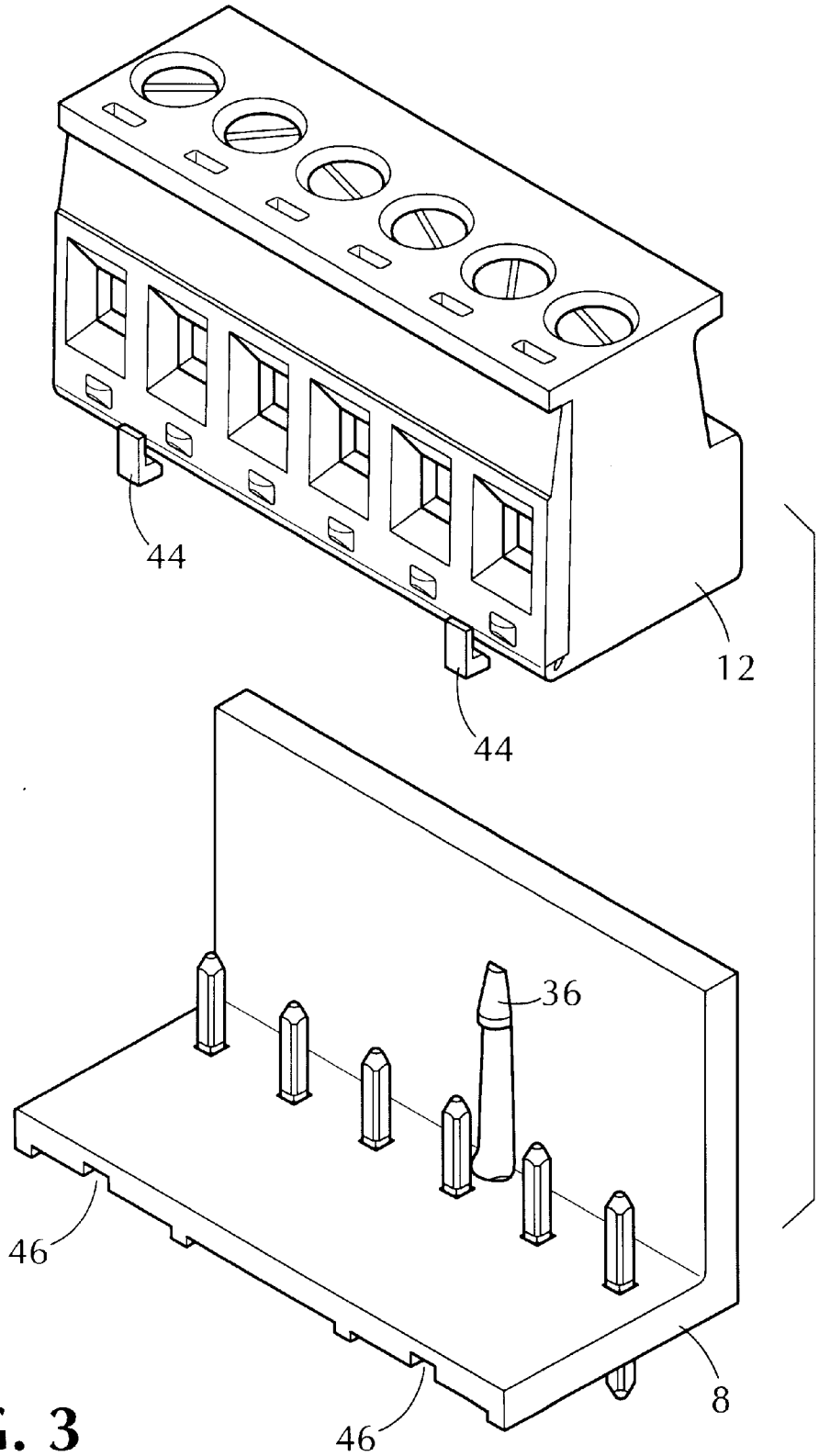
FIG. 3 is an exploded, perspective view of an alternative design for the first embodiment of the electrical connector assembly of the present invention.

FIG. 3 illustrates an alternative design for the first embodiment according to the present invention. In this embodiment, the second interlocking portion is in the same position as shown in FIG. 2 (i.e., on the rear of the assembly), however, the first interlocking portions now include two hook-like elements 44 on the plug 12, replacing the small cam element 32 shown in FIG. 2. The hook-like elements 44 are received in receiving portions 46 located on the front bottom portion of the header 8. By using this arrangement, the front wall of the header 8 is eliminated. The first interlocking section in this embodiment may also be reversed such that the hook-like elements are protruding out from the front bottom surface of the header 8, and the receiving portions are placed on the plug 12. In addition, it is usually only necessary to include a single hook-like element 44 and receiving portion 46, although multiple elements 44 and portions 46 may be used (depending on the design criteria for the particular application).

Figure 4B:
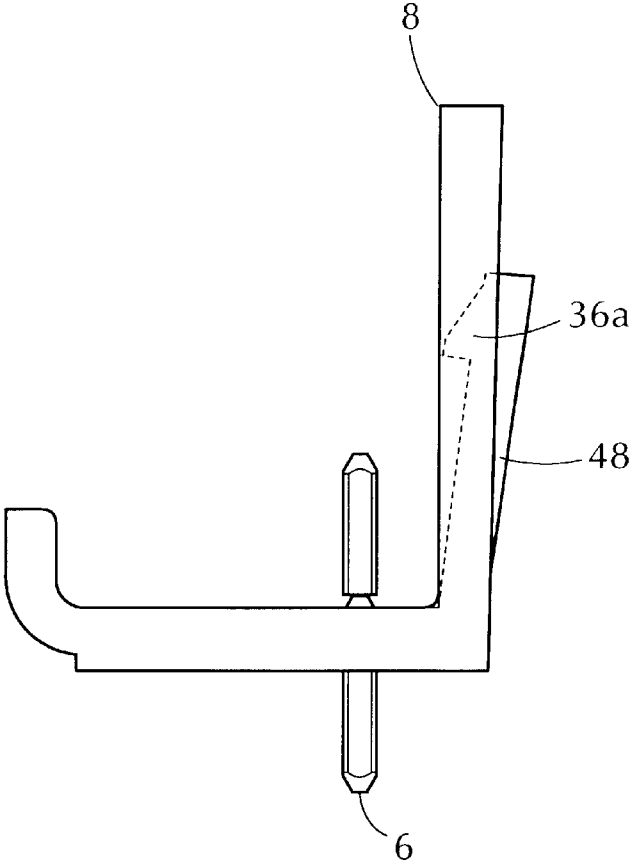
FIG. 4B is a side view of an alternative design for the interlocking portion of the header for the electrical connector assembly according to the first embodiment of the present invention.
Figure 4A:
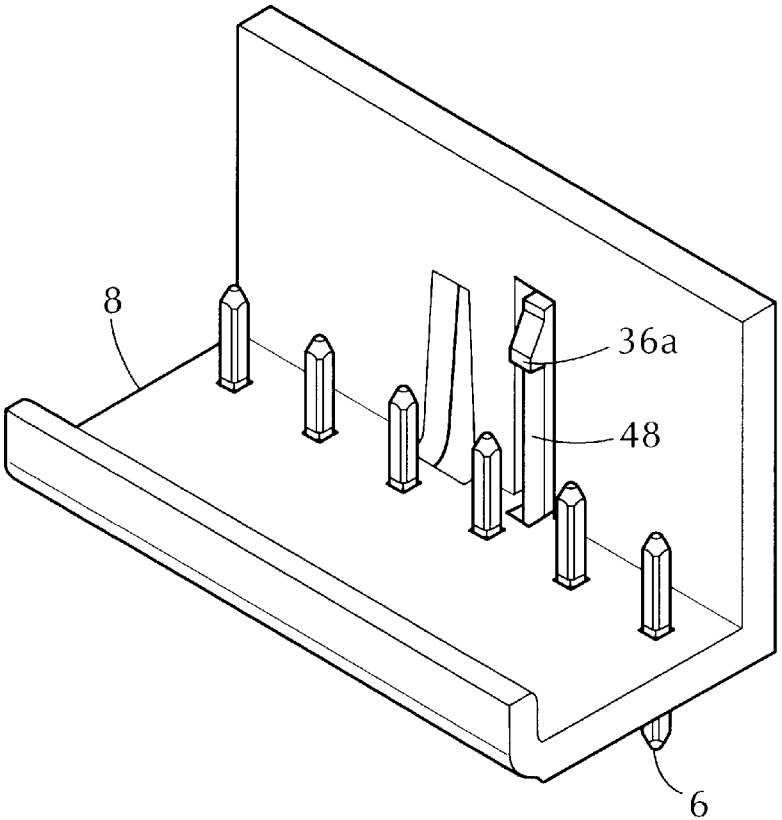
FIG. 4A is a perspective view of an alternative header design for the electrical connector assembly according to the first embodiment of the present invention.

FIGS. 4A and 4B illustrate another design for the first embodiment for the present invention. The second interlocking portion on the back wall of the header now includes a flexible member 48 which is designed to flex to accommodate the additional space required by the cam 36*a* to lock into place. Specifically, when the rear part of the plug 12 is pushed down to "snap" into the header, only the flexible member 48 flexes to accommodate the cam 36*a*; the rear wall stays in place. Single or multiple flexible members may also be used. The first interlocking portion, used in connection with this alternative design for the second interlocking portion, can be as described in any of the ways described in the other embodiments.

Figure 5:
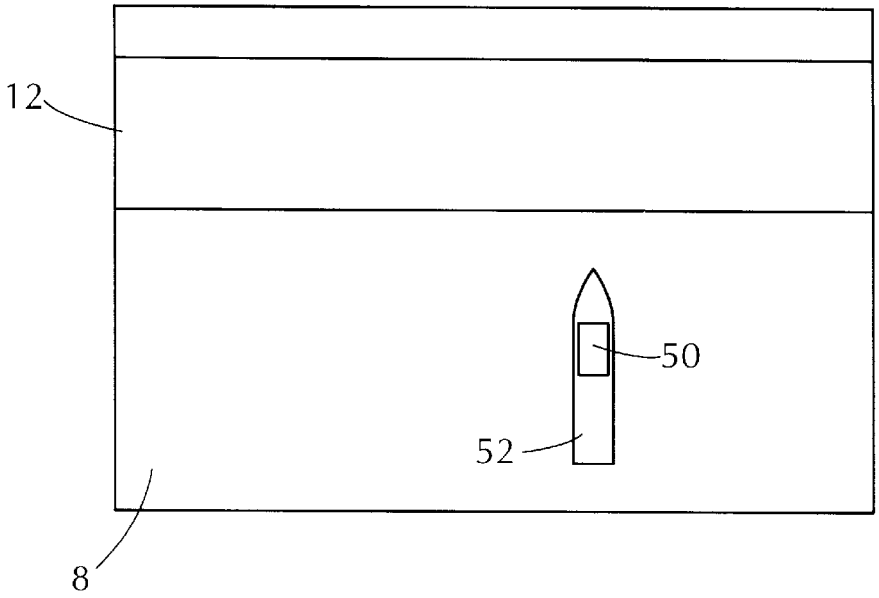
FIG. 5 is a rear view of an electrical connector assembly according to a second embodiment of the present invention.

FIG. 5 illustrates a second embodiment of the present invention. The second embodiment further addresses the problem of misconnection due to placing the electrical contact portions of the plug onto the wrong electrical contact portions of the header. To insure that the plug is in proper alignment prior to connection to the header, a guiding member 50 positioned on plug 12 is provided for and is received by a guiding member receiving portion 52 positioned on one of the walls of the header 8. The guiding member 50 and guiding member receiving portion 52 insure correct alignment between the plug and header, resulting in the proper connection between the electrical contact portions between each. Of course, the guiding member 50 may be positioned on the header 8, and likewise the guiding member receiving portion may be positioned on the plug 12.

The present embodiment, and alternative designs described herein, provide for error free mating of the plug to the header. If the plug is not correctly aligned with the header, then positive engagement will not be possible.

Figure 6:
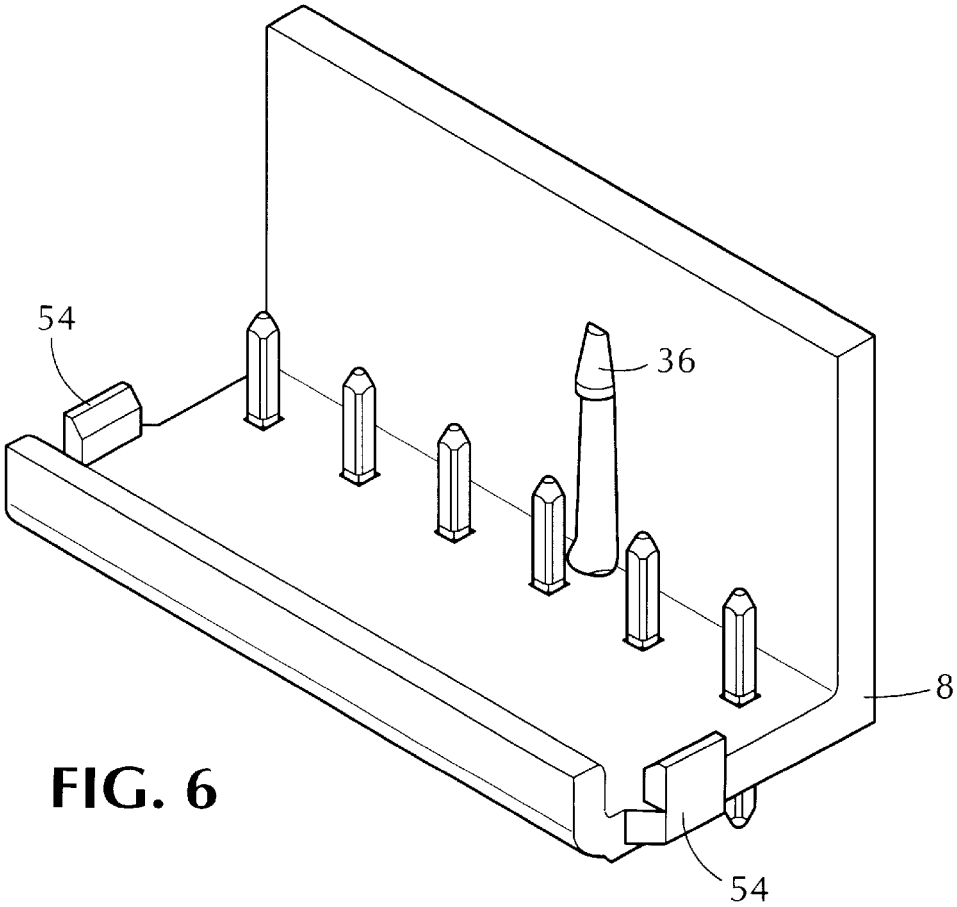
FIG. 6 is a perspective view of an alternative header design for the electrical connector assembly according to the second embodiment of the present invention.
Figure 7:
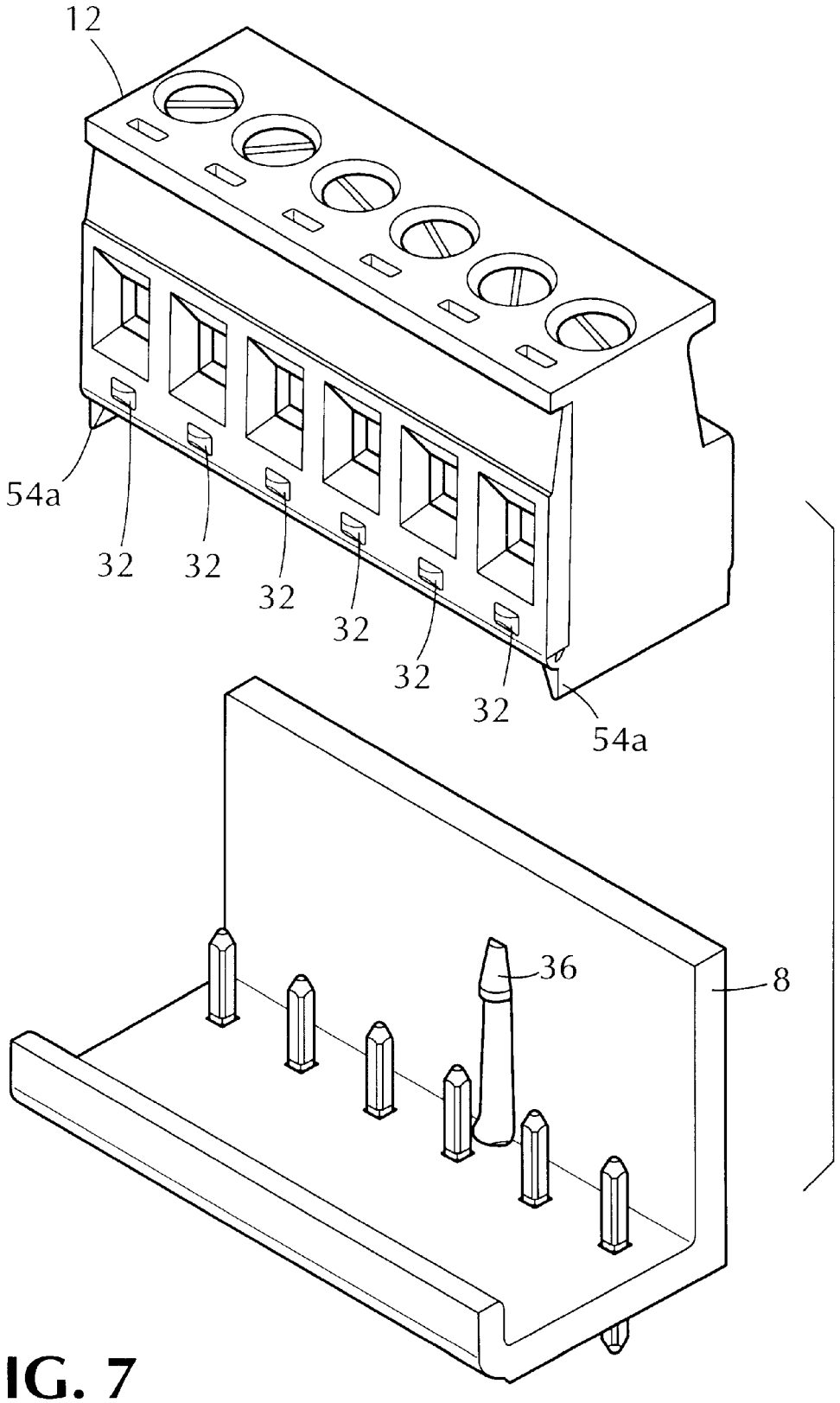
FIG. 7 is an exploded perspective view of an alternative electrical connector assembly design according to the second embodiment of the present invention.

FIGS. 6 and 7 illustrate alternative designs for the second embodiment for the present invention. In FIG. 6, alignment guides 54 disposed on either side of the header 8, are received by the sides of a plug connector. The opposite arrangement to that of FIG. 6, where the plug contains the alignment guides 54*a*, instead of the header, is illustrated in FIG. 7. Both arrangements are equally effective in insuring correct connection between the plug 12 and the header 8.

Figure 8:
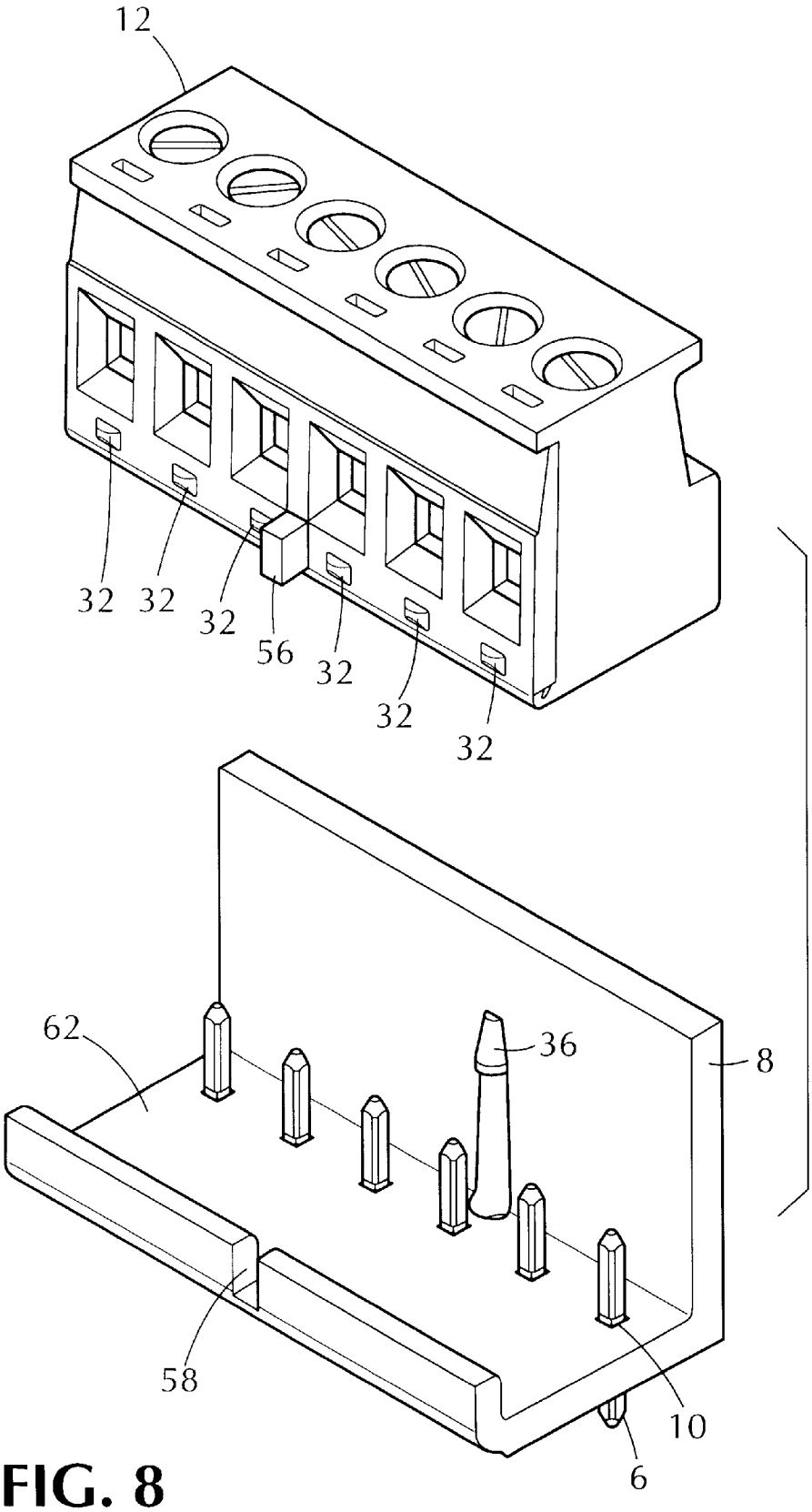
FIG. 8 is an exploded perspective view of an alternative electrical connector assembly design according to the second embodiment of the present invention.

FIG. 8 illustrates another alternative for the second embodiment of the electrical connection assembly according to the present invention. In this case, an alignment guide 56 is positioned on the front lower portion of the plug 12, where it is received by a cut-out portion 58 located in a corresponding position on the front wall 34 of the header 8.

In addition, as with the other embodiments, the guide and cutout illustrated in FIG. 8 may be reversed. In this case, the guide is provided for on the front lower wall of the header 8, and the guide receiving portion, or cut-out, is located on the plug 12. Furthermore, the guide and guide receiving portion may also be located on the rear wall and portion of the plug 12 and the header 8. Finally, a plurality of guide members and cut-out receiving portions may also be provided for on both the front and rear portions of the assembly if required by the application in which the assembly is used.

Figure 9:
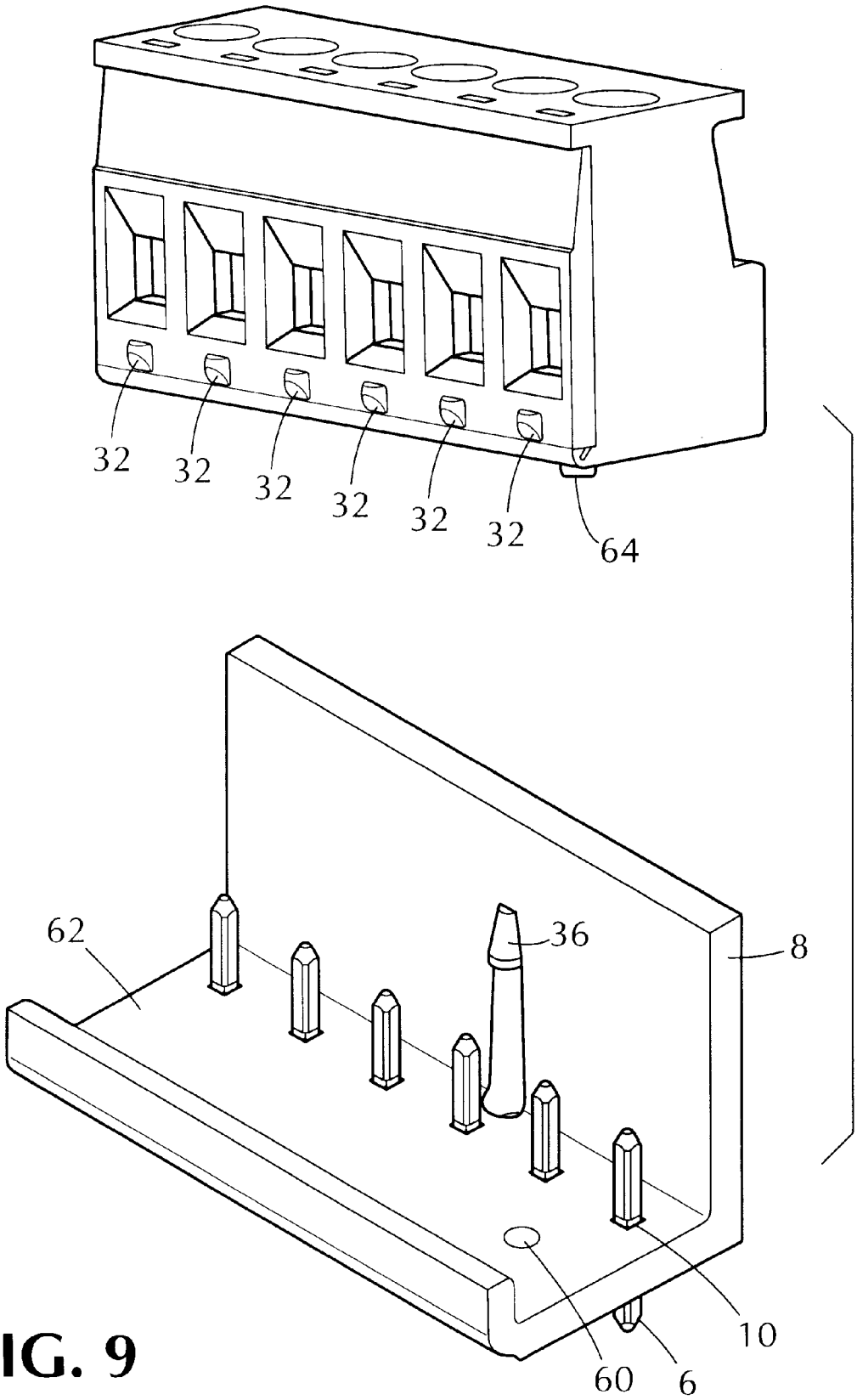
FIG. 9 is an exploded perspective view of an alternative electrical connector assembly design according to the second embodiment of the present invention.

FIG. 9 illustrates yet another design for the second embodiment. In this design, header 8 includes the guide receiving portion 60 in the bottom wall 62, near the electrical contact receiving portion 10. The plug 12 includes the guide member 64, on the bottom thereof, for insertion into the guide receiving member 60. The guide member 64 and guide receiving member 60 may alternatively be provided on either of the plug 12 or header 8, and can be located at any position on the bottom portion. Further, multiple guide members and corresponding receiving members may also be used.

FIGS. 10A–C illustrate a third embodiment of the present invention. In this embodiment, the guide members and latching mechanism are integrated. Specifically, walls 66 and 68 of plug 12 extend out laterally and contain surface recesses to receive latching prongs 70 and rear 72 latching prongs from the header 8. The ends of the prongs are designed to flex towards one another to accommodate the initial constricted opening 74 between walls 66 and rear 68 walls of the header 8. When the ends of the prongs reach the top portions of the wall extensions 66 and 68 of the plug 12, the plug locks into place with an audible "snap" into the header 8. Thus, there is only one way in which the plug 12 can fit into the header 8, and be secured thereto insuring proper connection.

It will also be appreciated by one skilled in the art, that the header 8 may be designed so that the front and rear walls contain recesses similar to those shown in FIG. 10A on the extensions of the opposed walls of plug 12, to accommodate prong-shaped protruding members at the ends of the plug.

Figure 11B:
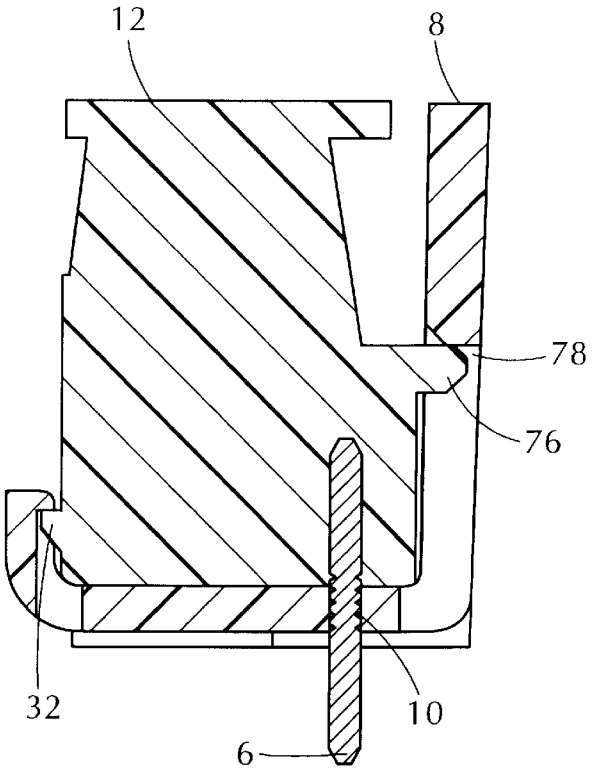
FIG. 11B is a side sectional view of the alternative electrical connector assembly design according to the third embodiment of the present invention.
Figure 11A:
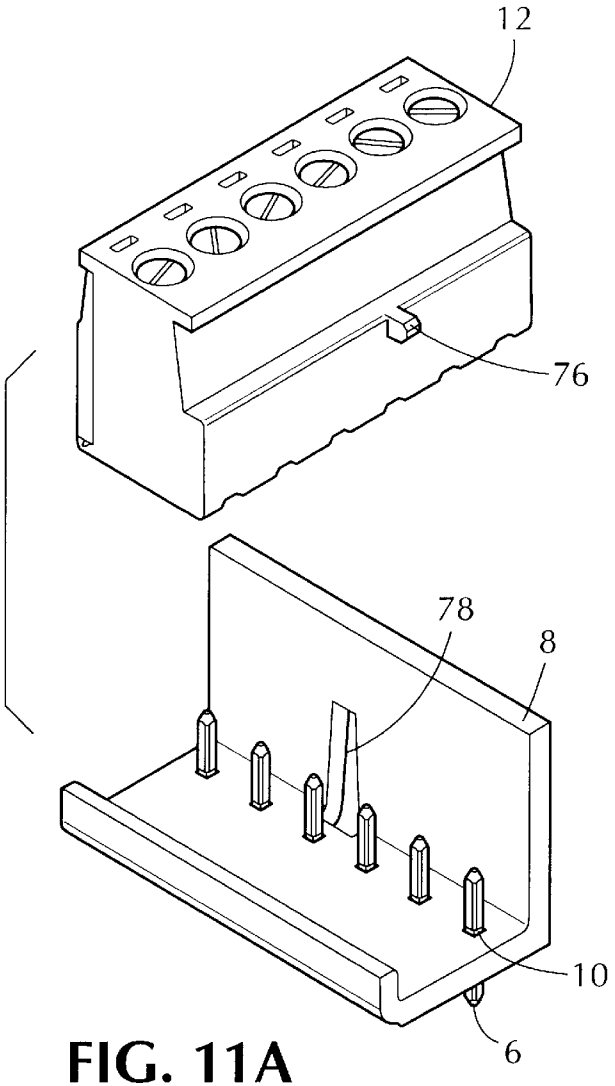
FIG. 11A is an exploded perspective view of an alternative plug and header electrical connector assembly design according to the third embodiment of the present invention.

FIGS. 11A and 11B illustrate another design for the third embodiment. In this design, the second latching mechanism 76 is configured to act as an alignment guide for being received by corresponding receiving portion 78. It will also be appreciated by one of ordinary skill in the art that a plurality of alignment and latching features may also be used.

Figure 12:
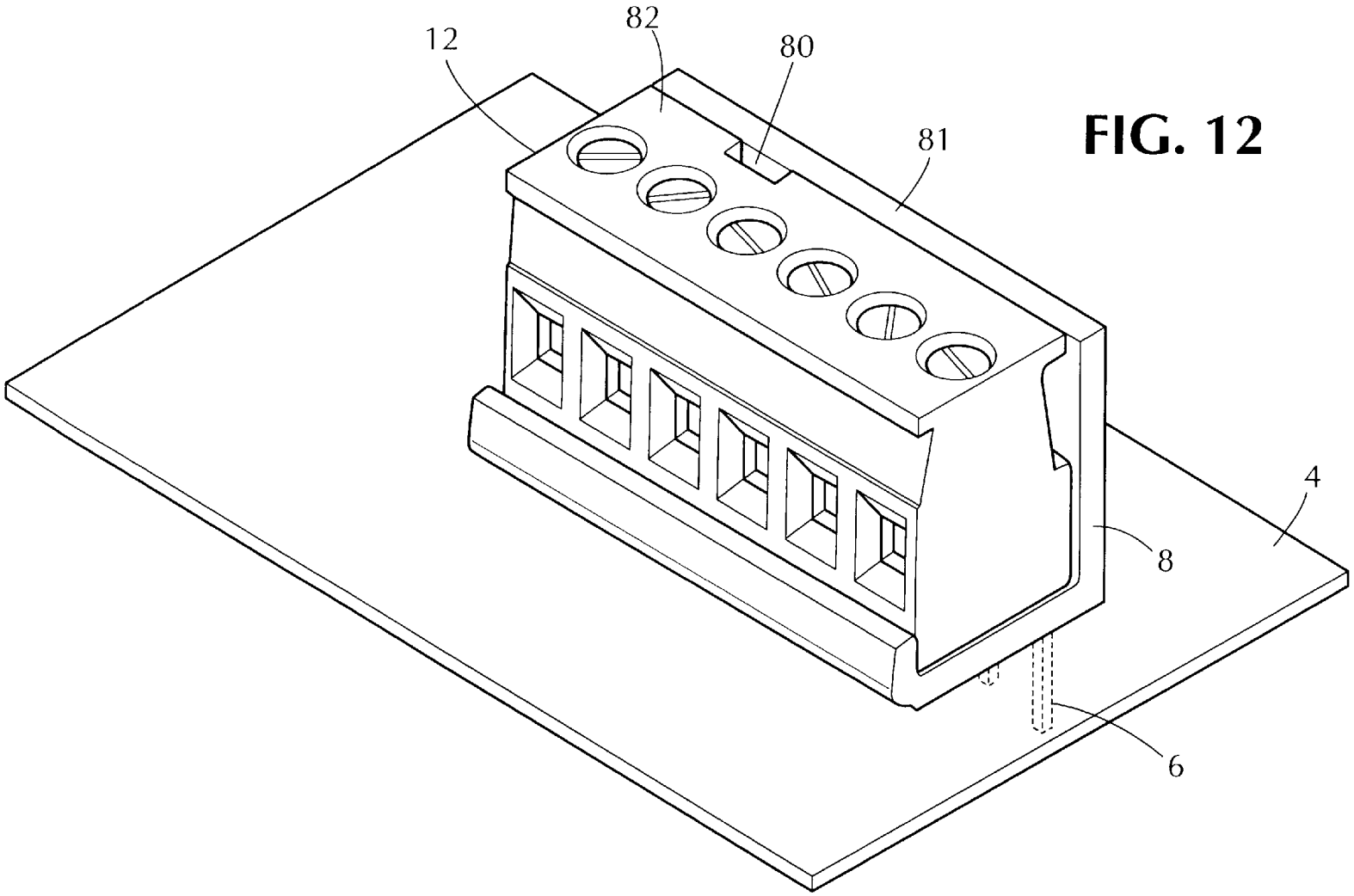
FIG. 12 is a perspective view of the electrical connector assembly according to the fourth embodiment of the present invention.

FIG. 12 illustrates a fourth embodiment of the present invention. In this embodiment, the assembly consists of the plug 12 having first (front) and second (rear) interlocking portions for locking into corresponding interlocking portions of the header 8. These interlocking portions can be configured according to the above embodiments and alternate designs thereof. In FIG. 12, the wall 81 of the header 8 is equal in height to the top surface 82 of the plug which provides a uniform surface to the top of the assembly. Along the top rear edge of the plug 12 located near the wall 81 of the header, a recess 80 is provided, to accept a tip of a flat-tip screwdriver or other removal tool. The tip of the screwdriver is inserted into the recess and using the edge of the plug as a fulcrum, the tip of the screwdriver flexes the rear wall 81 of the header back, while applying pressure to the plug in a direction away from the back wall 81 of the header. This instantly and easily disconnects the second interlocking portion of the assembly, rolling the plug away from wall 81, which ultimately leads to complete disconnection of the plug from the header.

It will be appreciated that where the top edge of the rear wall 81 of the header is located below the top surface 82 of the plug, a screwdriver may be used to disconnect the plug from the header in all of the above-mentioned embodiments.

While several embodiments and variations of the present invention for a electrical connector assembly are described in detail herein, it should be apparent that the disclosure and teachings of the present invention will suggest many other alternative designs to those skilled in the art. Accordingly, the present invention is not limited to the foregoing embodiments but is subject to various modifications within the scope and spirit of the claims.

What is claimed is:

1. A locking electrical plug connector for use in an electrical connector assembly, said plug comprising:

a plug body;

a first electrical contact portion located on said plug body capable of receiving a wire;

an opening in said plug body capable of receiving a second electrical contact from a header, said second electrical contact making electrical connection to said first electrical contact;

a first interlocking portion provided on a first side of said plug body, said first interlocking portion for interlocking with a corresponding first interlocking portion of said header; and a second interlocking portion located on a second side opposite from said first side for interlocking with a corresponding second interlocking portion of said header, wherein said second interlocking portion is spatially arranged at a vertical and horizontal distance away from said first interlocking portion.

2. A locking electrical header for use in an electrical connector assembly, said header comprising:

a first surface having a first interlocking portion for interlocking with a corresponding first interlocking portion of a plug;

a second surface having a second interlocking portion spatially arranged at a vertical and horizontal distance away from said first interlocking portion of said first surface for interlocking with a second interlocking portion of said plug; and a third surface integrated with said first and said second surfaces having an opening housing an electrical contact.

3. A locking electrical connector assembly comprising:

a plug comprising:

a plug body;

a first electrical contact portion located on said plug body capable of receiving a wire;

an opening in said plug body capable of receiving a second electrical contact from a header, said second electrical contact making electrical connection to said first electrical contact;

a first interlocking portion provided on a first side of said plug body, said first interlocking portion for interlocking with a corresponding first interlocking portion of said header; and a second interlocking portion located on a second side opposite from said first side for interlocking with a corresponding second interlocking portion of said header, said second interlocking portion spatially arranged at a vertical and horizontal distance away from said first interlocking portion; and said header comprising:

a first surface having said corresponding first interlocking portion;

a second surface having said corresponding second interlocking portion; and a third surface integrated with said first and said second surfaces having an opening housing an electrical contact.

4. A locking electrical connector assembly according to claim 3, said second electrical contact of said header is electrically connected to said first electrical contact of said plug when said plug is locked to said header by said first and said second interlocking portions.

5. A locking electrical connector assembly according to claim 3, wherein said plug body fits among said first, said second and said third surfaces of said header.

6. A locking electrical connector assembly according to claim 2, wherein a top edge of said first surface of said header is greater in height than a top edge of said second surface of said header.

7. A locking electrical connector assembly according to claim 3, wherein a top edge of said first surface of said header is greater in height than a top edge of said second surface of said header.

8. A locking electrical connector assembly according to claim 3, wherein a top edge of said first surface of said header is equal in height to a top edge of said second side of said plug when said plug is connected to said header.

9. A locking electrical connector assembly according to claim 7, wherein said first and said second interlocking portions of said header are provided near said top edge portions of said first surface and said second surface, respectively.

10. A locking electrical connector plug according to claim 1, wherein said first interlocking portion of said plug comprises a protruding member.

11. A locking electrical connector plug according to claim 1, wherein said first interlocking portion of said plug comprises a protruding member receiving portion.

12. A locking electrical header according to claim 2, wherein said first interlocking portion of said header comprises a protruding member.

13. A locking electrical header according to claim 2, wherein said first interlocking portion of said header comprises a protruding member receiving portion.

14. A locking electrical connector assembly according to claim 3, wherein said first interlocking portion of said header comprises a protruding member and said first interlocking portion of said plug comprises a protruding member receiving portion for receiving said protruding member of said first interlocking portion of said header when said plug and said header are being connected.

15. A locking electrical connector assembly according to claim 3, wherein said first interlocking portion of said plug comprises a protruding member and said first interlocking portion of said header comprises a protruding member receiving portion for receiving said protruding member of said first interlocking portion of said plug when said plug and said header are being connected.

16. A locking electrical connector plug according to claim 1, wherein said second interlocking portion of said plug comprises a protruding member.

17. A locking electrical connector plug according to claim 1, wherein said second interlocking portion of said plug comprises a protruding member receiving portion.

18. A locking electrical header according to claim 2, wherein said second interlocking portion of said header comprises a protruding member.

19. A locking electrical header according to claim 2, wherein said second interlocking portion of said header comprises a protruding member receiving portion.

20. A locking electrical connector assembly according to claim 3, wherein said second interlocking portion of said header comprises a protruding member and said second interlocking portion of said plug comprises a protruding member receiving portion for receiving said protruding member of said second interlocking portion of said header when said plug and said header are being connected.

21. A locking electrical connector assembly according to claim 3, wherein said second interlocking portion of said plug comprises a protruding member and said second interlocking portion of said header comprises a protruding member receiving portion for receiving said protruding member of said second interlocking portion of said plug when said plug and said header are being connected.

22. A locking electrical connector plug according to claim 1, wherein said plug body includes an alignment member.

23. A locking electrical connector plug according to claim 22, wherein said alignment member is provided for on one of said first and said second interlocking portions.

24. A locking electrical connector plug according to claim 1, wherein said plug body includes an alignment member receiving area.

25. A locking electrical connector plug according to claim 24, wherein said alignment member receiving area is provided for on one of said first and said second interlocking portions.

26. A locking electrical header according to claim 2, wherein one of said surfaces includes an alignment member.

27. A locking electrical header according to claim 26, wherein said alignment member is provided for on one of said first and said second interlocking portions.

28. A locking electrical header according to claim 2, wherein one of said surfaces includes an alignment member receiving area.

29. A locking electrical header according to claim 28, wherein said alignment member receiving area is provided for on one of said first and said second interlocking portions.

30. A locking electrical connector assembly according to claim 3, wherein said header includes an alignment member provided for on one of said surfaces and said plug includes an alignment member receiving area provided for on a side of said plug body located adjacent said alignment member when said plug and said header are connected.

31. A locking electrical connector assembly according to claim 30, wherein said alignment member is provided for on one of said first and said second interlocking portions of said plug, and said alignment member receiving area is provided for on the corresponding said first and said second interlocking portion of said header.

32. A locking electrical connector plug according to claim 1, wherein said plug body includes a recess defining an open space between said plug and said header when said plug and header are connected for insertion of a removal tool.

33. A locking electrical connector assembly according to claim 3, wherein said plug body includes a recess defining an open space between said plug and said header when said plug and header are connected for insertion of a removal tool.

* * * * *

UNITED STATES PATENT AND TRADEMARK OFFICE

CERTIFICATE OF CORRECTION

PATENT NO. : 6,146,181
DATED : November 14, 2000
INVENTOR(S) : Aaron M. Plaza

It is certified that error appears in the above-identified patent and that said Letters Patent is hereby corrected as shown below:

Title page,
Under item [75] ABSTRACT,
Line 3, "located" should read -- located on --.

Signed and Sealed this

First Day of January, 2002

*Attest:*

*Attesting Officer*

JAMES E. ROGAN
*Director of the United States Patent and Trademark Office*